US011510843B2

(12) United States Patent
Zibley et al.

(10) Patent No.: US 11,510,843 B2
(45) Date of Patent: Nov. 29, 2022

(54) WALKER

(71) Applicant: Purdue Research Foundation, West Lafayette, IN (US)

(72) Inventors: Peter Christian Zibley, Phoenix, AZ (US); Peerapak Adsavakulchai, Chicago, IL (US); Cara Ellen Birschbach, Barcelona (ES); Adalberto Angel Gonzalez, Round Rock, TX (US); Jaclyn Marie Kowalski, The Colony, TX (US); Beatrice Lai Kuan Lim, San Diego, CA (US)

(73) Assignee: Purdue Research Foundation, West Lafayette, IN (US)

( * ) Notice: Subject to any disclaimer, the term of this patent is extended or adjusted under 35 U.S.C. 154(b) by 70 days.

(21) Appl. No.: 17/167,283

(22) Filed: Feb. 4, 2021

(65) Prior Publication Data

US 2021/0236377 A1 Aug. 5, 2021

Related U.S. Application Data

(60) Provisional application No. 62/969,754, filed on Feb. 4, 2020.

(51) Int. Cl.
*A61H 3/04* (2006.01)
*A61H 3/00* (2006.01)

(52) U.S. Cl.
CPC ..... *A61H 3/04* (2013.01); *A61H 2003/001* (2013.01); *A61H 2201/0192* (2013.01)

(58) Field of Classification Search
CPC ..... A61H 3/00; A61H 3/04; A61H 2003/001
See application file for complete search history.

(56) References Cited

U.S. PATENT DOCUMENTS

| | | | | | |
|---|---|---|---|---|---|
| 5,263,506 | A * | 11/1993 | Narramore | A61H 3/00 | 135/74 |
| 5,649,558 | A * | 7/1997 | Richard | A61H 3/00 | 135/69 |
| 5,740,825 | A * | 4/1998 | Brunengo | A61H 3/00 | 482/68 |
| 6,453,921 | B1 * | 9/2002 | Rost | A61H 3/00 | 482/68 |
| 9,895,281 | B1 * | 2/2018 | Sigsworth | A61H 3/00 | |
| 2017/0014298 | A1 * | 1/2017 | O'Sullivan | A61H 3/04 | |

* cited by examiner

*Primary Examiner* — Noah Chandler Hawk
(74) *Attorney, Agent, or Firm* — Hartman Global IP Law; Gary M. Hartman; Domenica N. S. Hartman

(57) ABSTRACT

Walkers capable of adapting to surrounding environments, including stairs, curbs, sidewalks, and other surface or ground obstacles that have adjacent uneven surfaces. The walkers include a frame assembly having back legs, front legs, and a handlebar fixedly coupled to the back legs. Intermediate members respectively couple the front legs to the back legs and are configured for selective vertical adjustment of vertical positions of the front legs relative to the back legs and relative to at least a first surface engaged by lower ends of the back legs. After selective vertical adjustment of the vertical positions of the front legs, the front and back legs of the walker are capable of engaging and supporting the walker on the first surface engaged by the lower ends of the back legs and engaging and supporting the walker on at least a second surface engaged by lower ends of the front legs.

18 Claims, 3 Drawing Sheets

WALKER

CROSS-REFERENCE TO RELATED APPLICATIONS

This application claims the benefit of U.S. Provisional Application No. 62/969,754 filed Feb. 4, 2020, the contents of which are incorporated herein by reference.

BACKGROUND OF THE INVENTION

The present invention generally relates to mobility assistance devices. The invention particularly relates to walkers capable of adaptively adjusting to uneven surfaces.

Many individuals with mobility limitations, such as the elderly, disabled individuals, and people undergoing physiotherapeutic rehabilitation, often rely on walkers for mobility assistance. As the term is used herein, a walker is a device with multiple interconnected legs, often two front two legs that may have wheels attached thereto and two back legs optionally with wheels or glides, to provide a user with additional support that promotes balance and stability while walking by allowing the user to transfer part of their body weight to the walker through the user's arms. Walkers typically are constructed of a lightweight frame that defines the legs and a pair of handholds that can be grasped by a user to balance their weight. The typical frame may be roughly waist high, approximately twelve inches (30 cm) deep, and slightly wider than the user.

Many current walkers are rigid and do not provide adjustments for stairs, curbs, sidewalks, and other ground obstacles that have adjacent uneven surfaces (i.e., surfaces that have different vertical elevations). This may limit access of users to only places and transportation that have ramps, lifts, or elevators. Therefore, it would be desirable if walkers were available that were capable of promoting a more accessible and adaptive walking experience for people with mobility limitations.

BRIEF DESCRIPTION OF THE INVENTION

The present invention provides walkers that are adapted for use by individuals and capable of adapting to surrounding environments, including stairs, curbs, sidewalks, and other surface or ground obstacles that have adjacent uneven surfaces.

According to one aspect of the invention, a walker includes a frame assembly having first and second back legs, first and second front legs, and a handlebar fixedly coupled to the first and second back legs. Intermediate members couple the first and second front legs to the first and second back legs, respectively, and are configured for selective vertical adjustment of vertical positions of the first and second front legs relative to the first and second back legs and relative to at least a first surface engaged by lower ends of the first and second back legs. After selective vertical adjustment of the vertical positions of the first and second front legs, the first and second front legs and the first and second back legs of the walker are capable of engaging and supporting the walker on the first surface engaged by the lower ends of the first and second back legs and simultaneously engaging and supporting the walker on at least a second surface engaged by lower ends of the first and second front legs.

Technical effects of a walker as described above preferably include the capability of adaptively adjusting the vertical positions of the front legs relative to the back legs such that the walker is able to remain stable when traversing adjacent uneven surfaces, such as stairs, curbs, sidewalks, and other surface or ground obstacles.

Other aspects and advantages of this invention will be appreciated from the following detailed description.

DETAILED DESCRIPTION OF THE INVENTION

Figure 1:
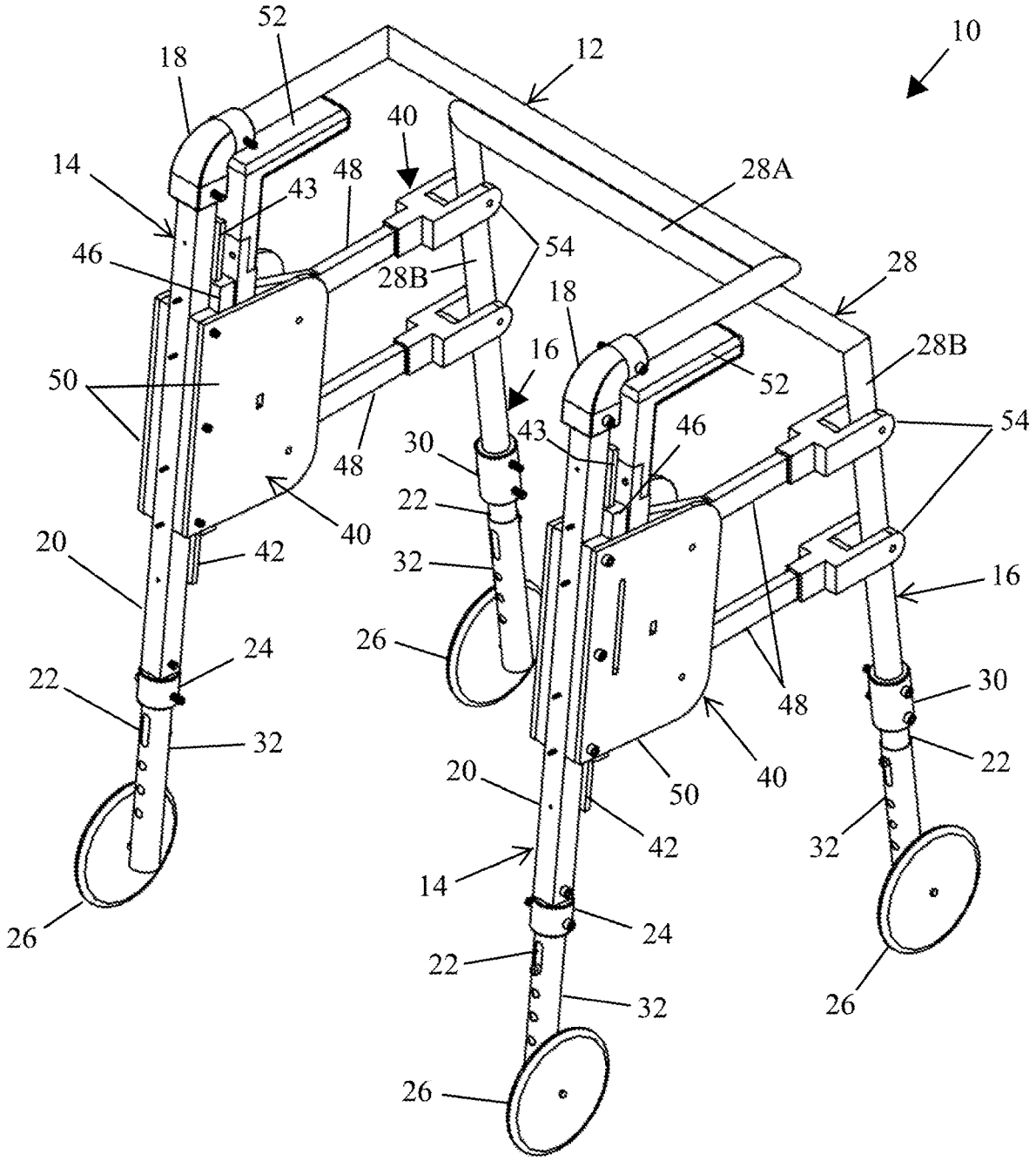
FIGS. 1 and 2 represent rear and front perspective views, respectively, of a walker in accordance with certain nonlimiting aspects of the invention.
Figure 2:
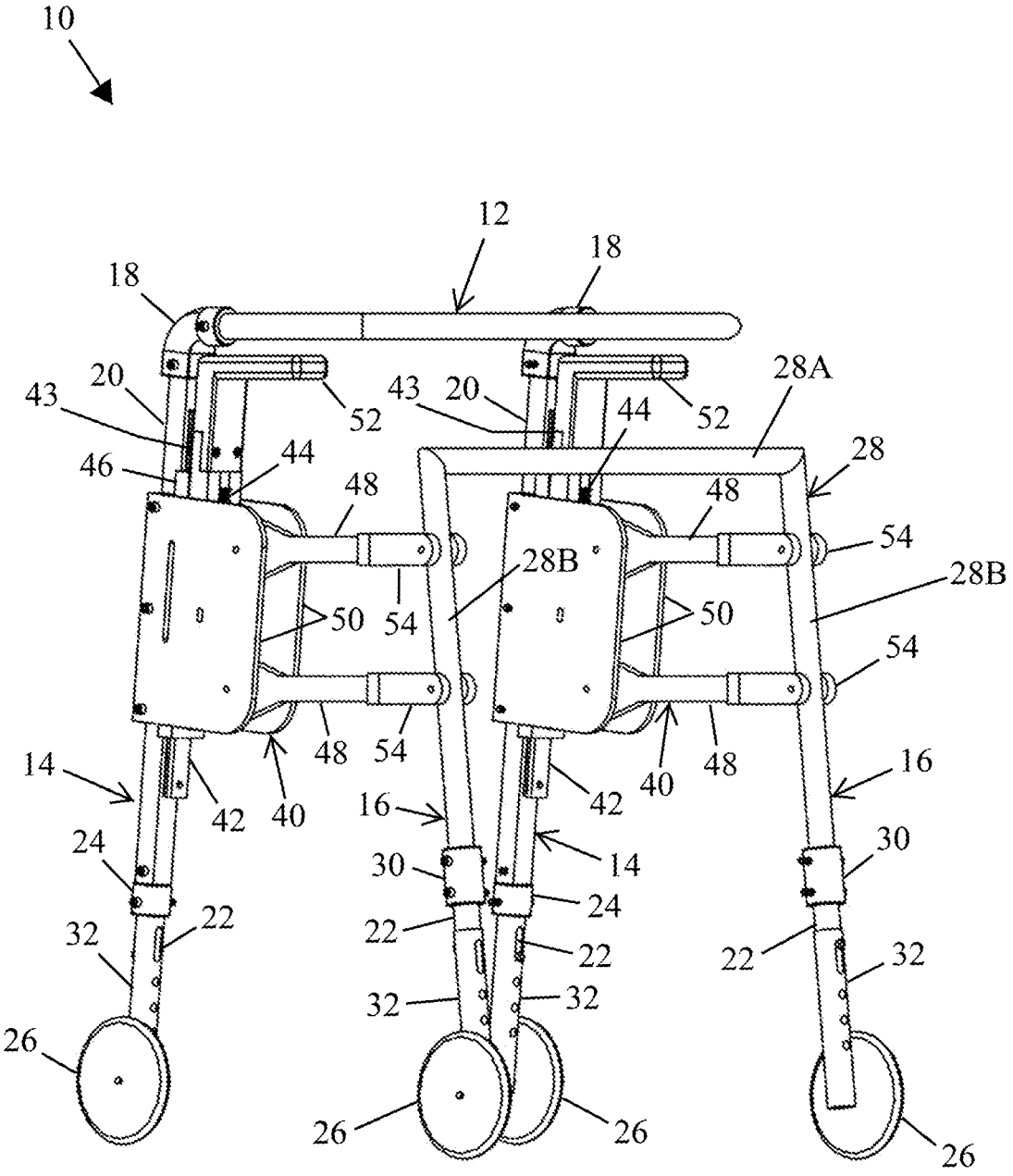

FIGS. 1 and 2 represent a mobility assistance device, hereinafter, walker 10, that promotes user mobility by adapting to surrounding environments, including stairs, curbs, sidewalks, and other surface and ground obstacles that have adjacent uneven surfaces (i.e., surfaces that have different vertical elevations). The walker 10 is configured to be selectively capable of vertical (height) adjustments while a user is using the walker 10 to traverse surfaces that have adjacent uneven surfaces, while simultaneously allowing the user to transfer part of their body weight to the walker through the user's arms.

To facilitate the description provided below of the embodiment represented in the drawings, relative terms, including but not limited to, "vertical," "horizontal," "lateral," "front," "rear," "side," "forward," "rearward," "upper," "lower," "above," "below," "right," "left," etc., may be used in reference to an orientation of the walker 10 during its operation, and therefore are relative terms that are useful to describe the construction and use of the invention but should not be necessarily interpreted as limiting the scope of the invention.

The nonlimiting embodiment of the walker 10 schematically represented in FIGS. 1 and 2 includes a frame assembly having a U-shaped handlebar 12, a pair of back legs 14, and a pair of front legs 16. Each front leg 16 is positioned forward of a complementary one of the back legs 14, such that each back leg 14 is aligned with one of the front legs 16 to create what may be termed a set of back and front legs 14 and 16. The handlebar 12 is fixedly coupled to the pair of back legs 14, for example, with angled coupling pieces 18. The back legs 14 each include a downwardly-extending tubular member 20, a wheel attachment member 22 telescopingly received in the tubular member 20 so as to be able to be selectively extended from and retracted into its tubular member 20, an adapter 24 coupling the wheel attachment member 22 to the tubular member 20, and a rotatable back wheel 26 coupled to the attachment member 22. The back wheels 26 constitute the lower ends of their respective back legs 14.

In the nonlimiting embodiment of FIGS. 1 and 2, the front legs 16 are defined by a pair of downwardly-extending portions 28B of a unitary U-shaped member 28 that also has a horizontal portion 28A interconnecting the downwardly-extending portions 28B. A wheel attachment member 22 is telescopingly received in each downwardly-extending portion 28B so as to be able to be selectively extended from and retracted into its downwardly-extending portion 28B. An adapter 30 couples each wheel attachment member 22 to its corresponding downwardly-extending portion 28B, and a rotatable front wheel 26 is coupled to each attachment member 22. The front wheels 26 constitute the lower ends of their respective front legs 16.

Each of the four wheel attachment members 22 of the back and front legs 14 and 16 preferably is represented as including an adjustable member 32 configured to selectively extend or retract along the longitudinal axis of its corresponding wheel attachment member 22. For example, the adjustable members 32 may be releasably fixed relative to the wheel attachment members 22 with a pin and hole locking system as shown, though other adjustment means are foreseeable. Each of the wheel attachment members 22 may incorporate a suspension system (not shown) configured to provide shock absorption in the legs 14 and 16 and act as a load transferring suspension system for a user's wrists and lower back while walking on uneven terrain. Such a suspension system may comprise means that biases each wheel attachment member 22 to extend from its tubular member 20 or downwardly-extending portion 28B in a direction parallel to its longitudinal direction and to function in combination with the pin and hole locking system as a result of the pin being able to travel vertically in a slot located at an upper extent of a row of the holes.

Unlike conventional walkers in which legs are fixed relative to one another, the walker 10 includes a rack and pinion system 40 that individually couples the back and front legs 14 and 16 of one of the aforementioned sets of back and front legs 14 and 16. The rack and pinion system 40 acts as intermediate members between the front half (including the U-shaped member 28 and its front legs 16) and rear half (including the back legs 14) of the walker 10 that enables relative movement between the front and rear halves. Such relative motion provides the functionality of adaptability for various surfaces. In particular, and as explained below, rack and pinion system 40 enables selective vertical adjustment of the vertical positions of the front legs 16 relative to the back legs 14 and, in doing so, also relative to a surface engaged by the lower ends (back wheels 26) of the back legs 14, enabling the back and front legs 14 and 16 of the walker 10 to engage and support the walker 10 on the surface engaged by the back wheels 26 as well as engage and support the walker 10 on at least a second surface engaged by lower ends (front wheels 26) of the front legs 16.

The rack and pinion system 40 includes rack members 44 that are coupled to rail units 42, each of which is slidably coupled to a rail 43 attached to a tubular member 20 of a back leg 14. A handle 52 is coupled to an upper end of each rail unit 42 so that the handles 52 are located adjacent and preferably beneath portions of the handlebar 12. In this manner, the rail units 42 and their respective rack members 44 are adapted to vertically translate along the tubular member 20 of each back leg 14 through the operation of the handles 52. As such, while grasping the handlebar 12, a user can grasp and pull either or both handles 52 upward to cause their respective rack members 44 to vertically translate. In FIGS. 1 and 2, pairs of guard plates 50 are shown as fixed to the tubular members 20 of the back legs 14 along sides thereof and extend toward the front legs 16 to cover and partially conceal the rack members 44 and rail units 42.

The rack and pinion system 40 further includes pairs of pinion members 48 that individually interconnect one of the sets of back and front legs 14 and 16. Each pinion member 48 is individually pivotably secured at a first end thereof to one of the guard plates 50 (at location A in FIG. 3) and individually pivotably secured with a forked connector 54 at a second end thereof to one of the front legs 16 (at location B in FIG. 3). In the nonlimiting embodiment represented in the drawings, the pinion members 48 are the only means for coupling the back and front legs 14 and 16 together. The rack and pinion system 40 is represented as having two pinion members 48 interconnecting each set of back and front legs 14 and 16. One pinion member 48 positioned vertically above the other, effectively creating a four-bar linkage in which the pinion members 48 are coupled to the back and front legs 14 and 16 so that of the pinion members 48 on each set of back and front legs 14 and 16 remain parallel to each other and move in a single plane. The arrangement and placement of more than one pinion member 48 interconnecting each set of back and front legs 14 and 16 promotes the stability and rigidity of the walker 10.

Figure 3:
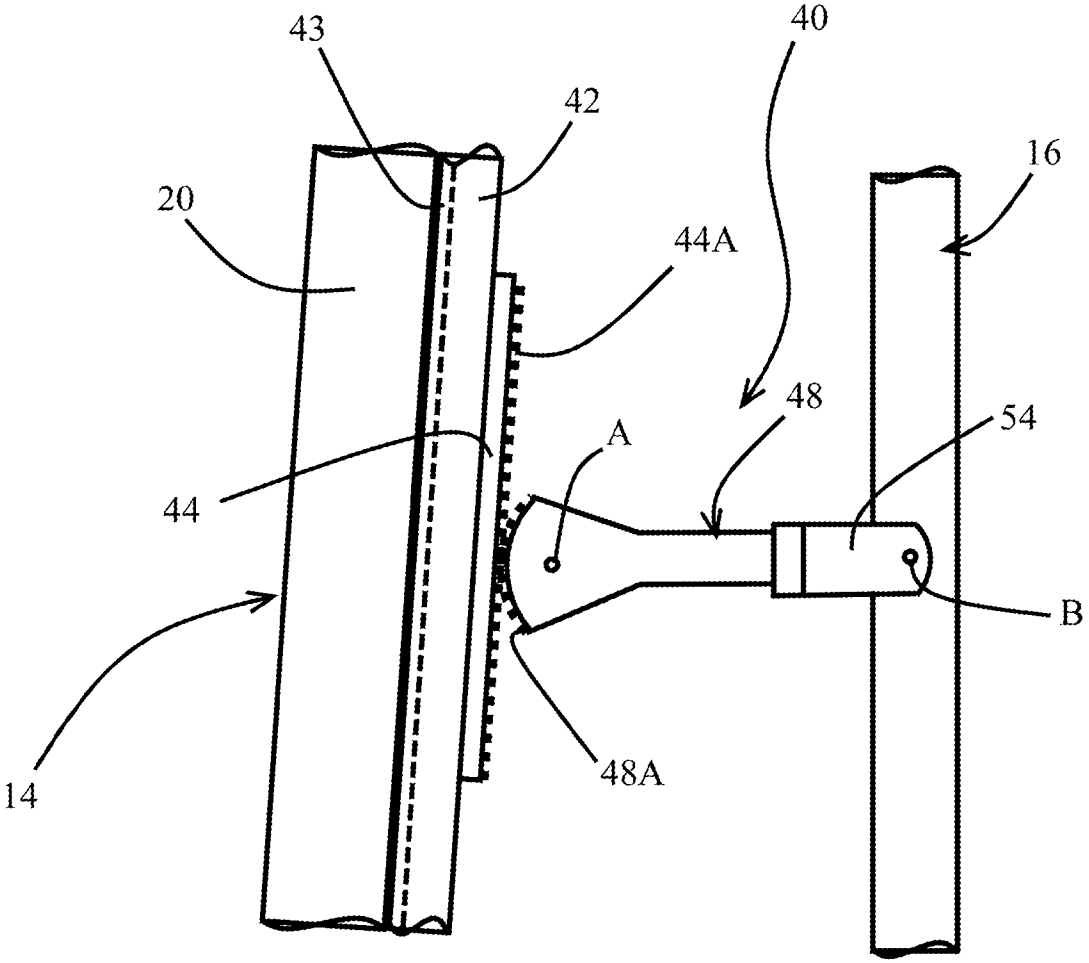
FIG. 3 is a fragmentary side view of the walker of FIGS. 1 and 2 showing in isolation a pinion member pivotally coupled to a front leg of the walker and having a rack engaged with a complementary rack mounted to a corresponding one of the back legs of the walker.

As evident from the isolated view of one of the rack and pinion systems 40 in FIG. 3, the first end of each pinion member 48 is curved and has a rack 48A formed thereon or attached thereto that interacts with a complementary rack 44A formed on or attached to one of the rack members 44. As a result, when the rack member 44 is caused to vertically translate through the operation of its handle 52, the linear motion of the rack member 44 is converted into a pivoting motion of the pinion member 48, and vice versa. The pivoting motion of a pinion member 48 is converted through its connector 54 into linear motion of the front leg 16 to which it is connected, thereby adjusting the vertical position of each front leg 16 relative to its corresponding back leg 14 when a rack unit 42 translated. Each pinion member 48 of a given set of back and front legs 14 and 16 preferably engages the same rack member 44, ensuring that the pinion members 48 remain parallel to each other, though it is foreseeable that the pinion members 48 associated with each set of back and front legs 14 and 16 could engage separate rack members 44 mounted to the same back leg 14.

In view of the above, the handles 52 of the walker 10 operate as height adjusting controllers that enable a user to translate the rack members 44 and thereby manually adjust the relative heights or positions of the front and back legs 16 and 14 and their respective wheels 26. Slide stops 46 limit the extent to which each rack unit 42 is able to translate along its rail 43. In this manner, the rack and pinion system 40 provides for vertical (height) adjustments of the front legs 16 when a user traverses stairs, curbs, sidewalks, or other surface or ground obstacles that have adjacent uneven surfaces. That is, the walker 10 may be used as the user traverses adjacent uneven surfaces and enables each of the four wheels 26 to remain engaged with and supported by different uneven surfaces, with the vertical movement of the front legs 16 relative to the back legs 14 being controllable with the handles 52 such that it is possible for the user to maintain the handlebar 12 approximately horizontal while traversing an uneven surface.

While the invention has been described in terms of a specific or particular embodiment, it should be apparent that alternatives could be adopted by one skilled in the art. For example, the walker 10 and its components could differ in appearance and construction from the embodiment described herein and shown in the drawings, functions of certain components of the walker 10 could be performed by components of different construction but capable of a similar (though not necessarily equivalent) function, and various materials could be used in the fabrication of the walker 10 and/or its components. Accordingly, it should be understood that the invention is not necessarily limited to any embodiment described herein or illustrated in the drawings. It should also be understood that the phraseology and terminology employed above are for the purpose of describing the disclosed embodiment, and do not necessarily serve as limitations to the scope of the invention. Therefore, the scope of the invention is to be limited only by the following claims.

The invention claimed is:

1. A walker comprising:

a frame assembly comprising first and second back legs, first and second front legs, and a handlebar fixedly coupled to the first and second back legs; and intermediate members coupling the first and second back legs to the first and second front legs, respectively, and configured to provide selective vertical adjustment of vertical positions of the first and second front legs relative to the first and second back legs and relative to a first surface engaged by lower ends of the first and second back legs and enable the first and second front and back legs of the walker to engage and support the walker on the first surface engaged by the lower ends of the first and second back legs and simultaneously engage and support the walker on at least a second surface engaged by lower ends of the first and second front legs;

wherein the intermediate members each include a rack and pinion system comprising a rail coupled to one of the first and second back legs, a rack member translatable along the rail, and at least one pinion member having a first end engaging the rack member and a second end pivotably coupled to one of the first and second front legs, wherein the rack and pinion system is configured to convert linear motion of the rack members as the rack members translate along the rails into pivoting motions of the pinion members and to convert the pivoting motions of the pinion members into linear motions of the first and second front legs thereby adjusting the vertical positions of the first and second front legs relative to the first and second back legs as the rack members translate along the rails.

2. The walker of claim 1, wherein the first ends of the pinion members have curved surfaces that interact with the rack members to convert the linear motions of the rack members as the rack members translate along the rails into the pivoting motions of the pinion members.

3. The walker of claim 1, further comprising height adjusting controllers that include handles configured to selectively translate the rack members along the rails for manual vertical adjustment of the vertical positions of the first and second front legs relative to the first and second back legs.

4. The walker of claim 1, further comprising wheels rotatably secured to lower ends of the first and second front legs.

5. The walker of claim 1, further comprising wheels rotatably secured to lower ends of the first and second back legs.

6. The walker of claim 1, further comprising adjustable members at lower ends of each of the first and second front and back legs configured to be selectively extended or retracted along the longitudinal axes of the first and second front and back legs to adjust the lengths of the first and second front and back legs.

7. The walker of claim 1, further comprising guard plates that are fixed to the first and second back legs, extend toward the first and second front legs, and at least partially conceal the rack members and the rails.

8. The walker of claim 1, wherein the intermediate members are the only coupling between the first and second back legs and the first and second front legs.

9. A walker comprising:

a frame assembly comprising first and second back legs, first and second front legs, and a handlebar fixedly coupled to the first and second back legs; and intermediate members coupling the first and second back legs to the first and second front legs, respectively, and configured to provide selective vertical adjustment of vertical positions of the first and second front legs relative to the first and second back legs and relative to a first surface engaged by lower ends of the first and second back legs and enable the first and second front and back legs of the walker to engage and support the walker on the first surface engaged by the lower ends of the first and second back legs and simultaneously engage and support the walker on at least a second surface engaged by lower ends of the first and second front legs, wherein the intermediate members comprise a rack and pinion system comprising:

at least first and second pinion members interconnecting the first back leg to the first front leg to create a first four-bar linkage in which the first and second pinion members remain parallel to each other and move in a single plane; and at least third and fourth pinion members interconnecting the second back leg to the second front leg to create a second four-bar linkage in which the third and fourth pinion members remain parallel to each other and move in a single plane.

10. A walker comprising:

a frame assembly comprising first and second back legs, first and second front legs, and a handlebar fixedly coupled to the first and second back legs; and a rack and pinion system coupling the first and second back legs to the first and second front legs, respectively, and configured to provide selective vertical adjustment of vertical positions of the first and second front legs relative to the first and second back legs and relative to a first surface engaged by lower ends of the first and second back legs and enable the first and second front and back legs of the walker to engage and support the walker on the first surface engaged by the lower ends of the first and second back legs and simultaneously engage and support the walker on at least a second surface that is engaged by lower ends of the first and second front legs and at a different vertical elevation than the first surface, wherein the rack and pinion system comprises a first rail coupled to the first back leg, a first rack member translatable along the first rail, and a first pinion member having a first end engaging the first rack member and a second end pivotably coupled to the first front leg.

11. The walker of claim 10, wherein the rack and pinion system further comprises:

a second rail coupled to the second back leg respectively;

a second rack member translatable along the second rail;

a second pinion member having a first end engaging the first rack member and a second end pivotably coupled to the first front leg;

third and fourth pinion members each having a first end engaging the second rack member and a second end pivotably coupled to the second front leg; and wherein the rack and pinion system is configured to convert linear motion of the first and second rack members as the first and second rack members translate along the first and second rails into pivoting motions of the first, second, third, and fourth pinion members and to convert the pivoting motions of the first, second, third, and fourth pinion members into linear motions of the first and second front legs thereby adjusting the vertical positions of the first and second front legs relative to the first and second back legs as the first and second rack members translate along the first and second rails.

12. The walker of claim 11, wherein the first, second, third, and fourth pinion members are the only coupling between the first back leg and the first front leg and between the second back leg and the second front leg.

13. The walker of claim 11, wherein:

the first and second pinion members interconnect the first back leg to the first front leg to create a first four-bar linkage in which the first and second pinion members remain parallel to each other and move in a single plane; and the third and fourth pinion members interconnect the second back leg to the second front leg to create a second four-bar linkage in which the third and fourth pinion members remain parallel to each other and move in a single plane.

14. The walker of claim 11, wherein the first ends of the first, second, third, and fourth pinion members have curved surfaces that interact with the first and second rack members to convert the linear motions of the first and second rack members as the first and second rack members translate along the first and second rails into the pivoting motions of the first, second, third, and fourth pinion members.

15. The walker of claim 11, further comprising guard plates that are fixed to the first and second back legs, extend toward the first and second front legs, and at least partially conceal the first and second rack members and the first and second rails.

16. The walker of claim 10, further comprising a height adjusting controller that include a handle configured to selectively translate the first rack member along the first rail for manual vertical adjustment of the vertical positions of the first and second front legs relative to the first and second back legs.

17. The walker of claim 10, further comprising wheels rotatably secured to lower ends of at least one of the first and second front legs and the first and second back legs.

18. The walker of claim 10, further comprising adjustable members at lower ends of each of the first and second front and back legs configured to be selectively extended or retracted along the longitudinal axes of the first and second front and back legs to adjust the lengths of the first and second front and back legs.

* * * * *